US009370227B2

(12) United States Patent
Ghantous et al.

(10) Patent No.: US 9,370,227 B2
(45) Date of Patent: Jun. 21, 2016

(54) CUSTOMIZABLE CLUTCH WITH INTERCHANGEABLE SHELLS AND DROP-IN CLASPS

(71) Applicants: Eliana Ghantous, Woodland Hills, CA (US); Sami E. Ghantous, Woodland Hills, CA (US)

(72) Inventors: Eliana Ghantous, Woodland Hills, CA (US); Sami E. Ghantous, Woodland Hills, CA (US)

( * ) Notice: Subject to any disclaimer, the term of this patent is extended or adjusted under 35 U.S.C. 154(b) by 490 days.

(21) Appl. No.: 14/037,101

(22) Filed: Sep. 25, 2013

(65) Prior Publication Data

US 2015/0083288 A1 Mar. 26, 2015

(51) Int. Cl.
*A45C 3/08* (2006.01)

(52) U.S. Cl.
CPC ..... *A45C 3/08* (2013.01)

(58) Field of Classification Search
CPC ..... A45C 3/08; A45C 3/06; A45C 13/08; A45C 13/02; A45C 7/0086; A24F 23/00
USPC ..... 150/100, 103, 104, 105, 147; 206/1.5, 206/235, 242, 278, 305, 308.1, 37, 89; 220/4.22, 4.23, 4.24, 832, 840, 849; D3/247, 250, 282, 301, 303, 319; D6/632; D9/420, 423, 424
See application file for complete search history.

(56) References Cited

U.S. PATENT DOCUMENTS 1,358,540 A * 11/1920 Goodwin ..... A47K 5/02 206/263
1,526,839 A 2/1925 Dempsey
1,747,801 A 2/1930 Topal
1,960,396 A 5/1934 Rosenberg
1,978,971 A 10/1934 Thornhill
1,986,057 A * 1/1935 Hackworth ..... A45C 11/22 132/315
1,990,360 A 2/1935 Anish
2,004,185 A 6/1935 Blacher
2,006,463 A 7/1935 Landis
2,021,789 A 11/1935 Krauss
2,080,453 A 5/1937 Kraut
2,093,097 A 9/1937 Potash
2,107,201 A 2/1938 Krupp
2,110,480 A 3/1938 Goldberg
2,130,736 A 9/1938 Goldsmith
2,170,841 A 8/1939 Thies
2,183,428 A 12/1939 McNary
2,194,685 A 3/1940 Benigni
2,269,212 A 1/1942 Lubenstein
2,437,382 A 3/1948 Czap
2,653,640 A 9/1953 Browning
2,671,487 A 3/1954 Hoek
2,745,456 A 5/1956 Rubin
2,779,373 A 1/1957 Koepke
2,784,756 A 3/1957 Resnick
(Continued)

*Primary Examiner* — Fenn Mathew
*Assistant Examiner* — Cynthia Collado

(57) ABSTRACT

A customizable rigid clutch comprises a rigid main case having a pair of half sections, each attached along a bottom side by means of a hinge, an interchangeable outer shell having a pair of half sections, each having a lower clip along a bottom side, an interchangeable clasp having a pair of half sections, each having an insert, and a pair of hinge caps each having a pair of protrusions. A pair of upper insert receivers on the rigid case receives a pair of upper inserts on the interchangeable outer shell. A pair of hinge receivers on both sides of the hinge receives the lower clip of the interchangeable outer shell. A pair of inner slider housings attached along a top side of the main case receives the insert of the interchangeable clasp, and a pair of sliding bars is pushed into a locked position.

18 Claims, 10 Drawing Sheets

(56) References Cited

U.S. PATENT DOCUMENTS 2,798,524 A 7/1957 Ryon
2,809,685 A 10/1957 Lowy
2,836,288 A * 5/1958 Atchison ..... A24F 15/18 206/269
3,024,899 A * 3/1962 Reitzel ..... A24F 15/12 206/1.5
3,182,701 A 5/1965 Ginsburg
3,234,985 A 2/1966 Gilbert
3,414,033 A 12/1968 Tucker
3,536,116 A 10/1970 Margolis
3,623,580 A * 11/1971 Toller ..... A45C 5/00 190/115
3,727,657 A 4/1973 Landis
3,957,099 A 5/1976 Kery
4,027,710 A 6/1977 Keebler
4,037,633 A 7/1977 Gordon
D245,762 S * 9/1977 Takacs ..... D9/420
4,088,167 A 5/1978 Schwartz
4,270,590 A 6/1981 Marshall
4,349,120 A * 9/1982 DiNardo ..... B65D 43/164 16/267
D269,249 S * 6/1983 Cillario ..... D9/424
4,421,127 A * 12/1983 Geer ..... A45D 33/006 132/294
4,649,974 A 3/1987 Takanashi
4,684,017 A * 8/1987 Watanabe ..... A45D 33/22 16/265
4,754,790 A 7/1988 Meyers
4,856,570 A 8/1989 Rushing
4,907,633 A 3/1990 Eckstein
5,009,319 A 4/1991 Jantzen
5,427,543 A 6/1995 Cloesnner
5,560,476 A * 10/1996 Lee ..... A45C 11/18 206/305
5,649,581 A * 7/1997 Kopel ..... A45C 13/08 150/103
5,725,039 A 3/1998 Macinai
5,782,371 A 7/1998 Baerenwald
5,894,975 A 4/1999 Holden
5,911,262 A 6/1999 Steinhart
6,029,723 A 2/2000 Baquero
6,050,373 A * 4/2000 Wonka ..... A45C 5/03 190/103
6,074,094 A 6/2000 Manolizi
6,173,835 B1 1/2001 Swinger
6,186,201 B1 2/2001 Salz
6,237,660 B1 5/2001 Giardino
D443,414 S * 6/2001 Schimmel ..... D3/250
6,240,989 B1 * 6/2001 Masoud ..... A45C 11/18 150/149
6,286,667 B1 * 9/2001 Lee ..... G06F 15/02 206/305
6,382,280 B1 5/2002 Sands
6,422,278 B1 7/2002 Grogan
6,637,774 B2 * 10/2003 Gaska ..... B24F 9/005 281/45
6,712,509 B2 3/2004 Cappel
6,786,332 B1 * 9/2004 Patrick ..... A44B 15/005 206/305
6,820,664 B1 11/2004 Ritch
6,968,880 B2 11/2005 Battaglia
6,994,031 B2 * 2/2006 Huang ..... A61G 5/10 108/42
7,028,730 B2 4/2006 Pace
7,051,872 B2 * 5/2006 Bjerregaard ..... G11B 33/0427 206/308.1
D565,842 S * 4/2008 Falcone ..... D3/294
7,416,001 B2 * 8/2008 Speck ..... A45C 1/06 150/105
7,461,676 B2 12/2008 Huie
7,628,187 B2 12/2009 Mittelstaedt
7,927,997 B2 4/2011 Burns
8,028,730 B2 10/2011 Whiting
8,220,510 B2 7/2012 Armstrong
8,251,113 B2 8/2012 Baxter
8,342,750 B2 1/2013 Heinlen
8,505,768 B2 * 8/2013 Bardwell ..... A45C 11/20 206/564
8,567,459 B2 * 10/2013 Kitchen ..... A45C 11/182 150/147
D694,102 S * 11/2013 Bellamah ..... D9/424
2002/0029831 A1 3/2002 Pendergrass
2006/0011624 A1 * 1/2006 Shih ..... B25H 3/02 220/4.24
2007/0209742 A1 9/2007 Morgan
2009/0025842 A1 1/2009 Courville
2009/0065110 A1 3/2009 Cassella
2011/0000590 A1 1/2011 Welch
2012/0087601 A1 4/2012 Nathan
2012/0241059 A1 9/2012 Wilson
2012/0273100 A1 11/2012 Appleton

* cited by examiner

CUSTOMIZABLE CLUTCH WITH INTERCHANGEABLE SHELLS AND DROP-IN CLASPS

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE DISCLOSURE

This embodiment relates to clutches, and more particularly to a rigid customizable clutch with interchangeable outer shells and drop-in clasps.

DISCUSSION OF RELATED ART

Conventional handbags allow no flexibility in color coordination or in texture coordination with different clothing apparels that a user may wear. Such considerations are especially important in ladies' handbags and clutches. Modern fashion clutches are often of similar shape but have very different decorative clasps, which change the look and sometimes the function of the clutch. Users are forced to either purchase and store a number of different clutches for use with different apparel outfits, or they must use the same clutch even though the exposed surface may clash or is otherwise inappropriate for use on particular occasions. Owning several clutches is not only expensive but it also requires a lot of storage room in one's closet or suitcase. Further, moving the contents of one clutch into a different clutch can be a tedious process, and there is a risk that something important may be left behind unnoticed in a pocket of the original clutch.

Several attempts have been made to develop handbags and clutches with interchangeable covers for changing the external appearance. Various solutions have not entirely solved the current problems, including loss of items from open-mouth purses or purse inserts; increasing complexity of purses with interior pockets and flaps; inefficient means for fastening a cover to a foundation bag; and undesirable bulkiness or heaviness of the resulting handbag. Some handbags and purses provide embedded releasable snap fasteners to fasten detachable and interchangeable coverings and handles. However, these snap fasteners may easily come off and look unattractive.

In light of the foregoing, there is a need for a customizable clutch with interchangeable outer shells and drop-in clasps. Such a needed clutch would be rigid and easily customized to change its appearance. The customizable clutch would comprise a main case and interchangeable outer shells and drop-in clasps. The customizable clutch would also comprise an integrated locking mechanism that allows the clutch to easily interchange outer shells. Further, the clutch would comprise a drop-in clasp system that allows the clutch to easily interchange clasps or handles to provide desirable clutch designs and colours. Such a unique customizable rigid clutch would avoid the need for purchasing several clutches for coordination with different apparels that a user may wear. The present embodiment accomplishes these objectives.

SUMMARY OF THE DISCLOSURE

The present embodiment is a customizable rigid clutch with interchangeable outer shells and clasps. The customizable rigid clutch comprises a rigid main case, an interchangeable outer shell held by an integrated hinge and outer shell locking system, an interchangeable clasp held by a drop-in clasp system, interchangeable chains held by a pair of strap attachments. The main case serves as a platform for the interchangeable outer shell and the interchangeable clasp. The interchangeable outer shell and the interchangeable clasp may be easily changed for coordination with different apparels that a user may wear.

The rigid main case includes a pair of half sections, each of the pair of half sections attached along a bottom side by means of a hinge. A pair of upper insert receivers is positioned along a top side of the pair of half sections of the main case. A pair of inner slider housings is attached along a top side of the pair of half sections of the main case. Each of the pair of inner slider housings has a pair of sliding bars. The interchangeable outer shell includes a pair of half sections, each of the pair of half sections having a lower clip along a bottom side and a pair of upper inserts along a top inner surface for removably attaching with the main case. The interchangeable clasp includes a pair of half sections, each of the pair of half sections having an insert for removably attaching with the main case.

The interchangeable outer shell encloses the main case. The interchangeable outer shell is secured to the main case through the integrated hinge and outer shell locking system which includes a pair of hinge receivers on both sides of the hinge. The pair of upper insert receivers receives the pair of upper inserts and then the pair of hinge receivers receives the lower clip of each of the half sections of the interchangeable outer shell.

The interchangeable clasp is secured to the main case through the drop-in clasp system which includes the pair of inner slider housings each having the pair of sliding bars. The pair of sliding bars may be slid into a locked position and an unlocked position to attach and remove the interchangeable clasp to the main case respectively. To attach the interchangeable clasp to the main case, a user drops the insert of each of the pair of half sections of the interchangeable clasp into a corresponding cavity in each of the pair of inner slider housings and the pair of sliding bars is pushed into the locked position.

In one embodiment, the customizable clutch includes a pair of hinge caps, each having a pair of protrusions for removably attaching the interchangeable outer shell to the rigid main case. The rigid main case includes a pair of hinge cap receivers that is attached proximate each of the pair of hinge receivers. To secure the pair of hinge caps to the main case, a user slides the pair of hinge caps into place, such that the pair of protrusions on each of the pair of hinge caps slides into the pair of hinge cap receivers. The interchangeable outer shell is attached to the main case using the pair of hinge caps thereby preventing the interchangeable outer shell from backing out and dislodging from the main case. Thus, the pair of hinge caps provides an additional attachment point to lock the interchangeable outer shell with the rigid main case.

The present embodiment provides a customizable clutch with the integrated hinge and outer shell locking system that facilitates the attachment of the interchangeable outer shell and ensures the interchangeable outer shell stays securely attached to the main case. The customizable clutch allows users to purchase several outer shells and clasps which can then be interchanged depending on the outfit and avoid the need to purchase several clutches for coordination with different apparels that a user may wear. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

The following describes example embodiments in which the present invention may be practiced. This invention, however, may be embodied in many different ways, and the description provided herein should not be construed as limiting in any way. Among other things, the following invention may be embodied as methods or devices. As such, the present invention may take the form of an entirely hardware embodiment, an entirely software embodiment, or an embodiment combining software and hardware aspects. The following detailed descriptions should not be taken in a limiting sense.

In this document, the terms "a" or "an" are used, as is common in patent documents, to include one or more than one. In this document, the term "or" is used to refer to a nonexclusive "or," such that "A or B" includes "A but not B," "B but not A," and "A and B," unless otherwise indicated. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

Figure 1:
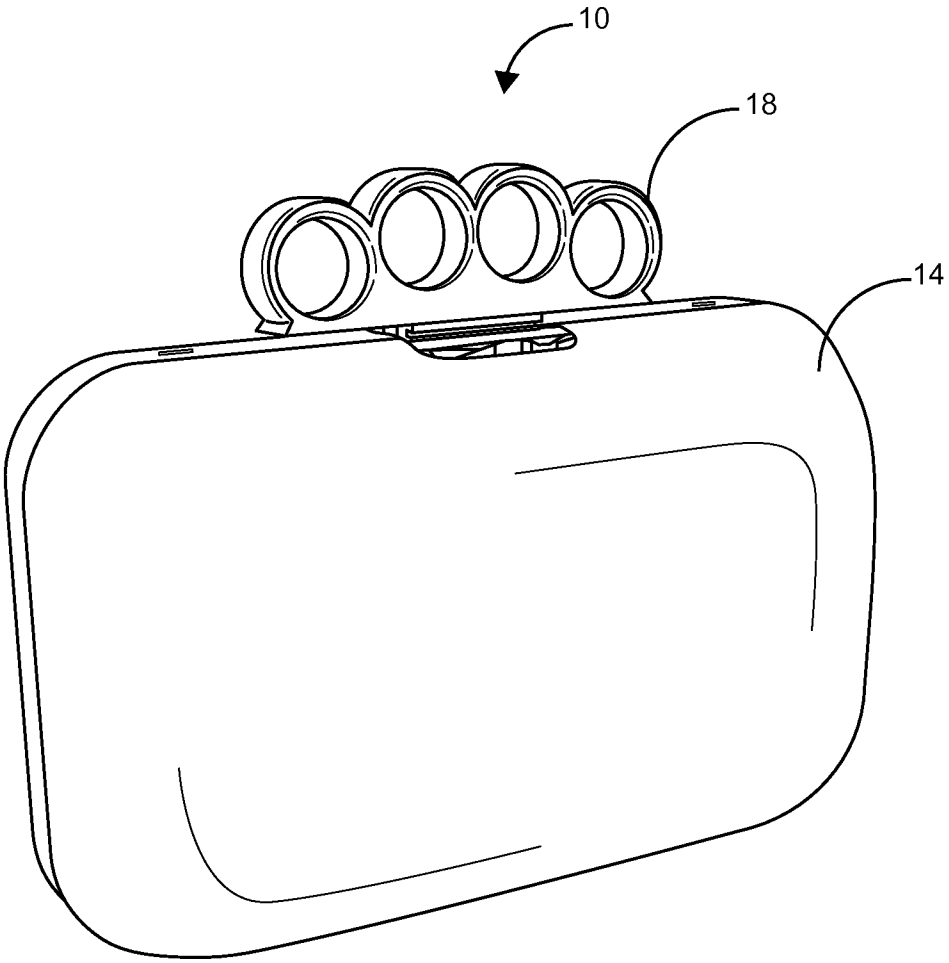
FIG. 1 is a perspective view of a customizable clutch in accordance with a preferred embodiment of the present invention, illustrating an interchangeable outer shell attached to a main case.
Figure 2:
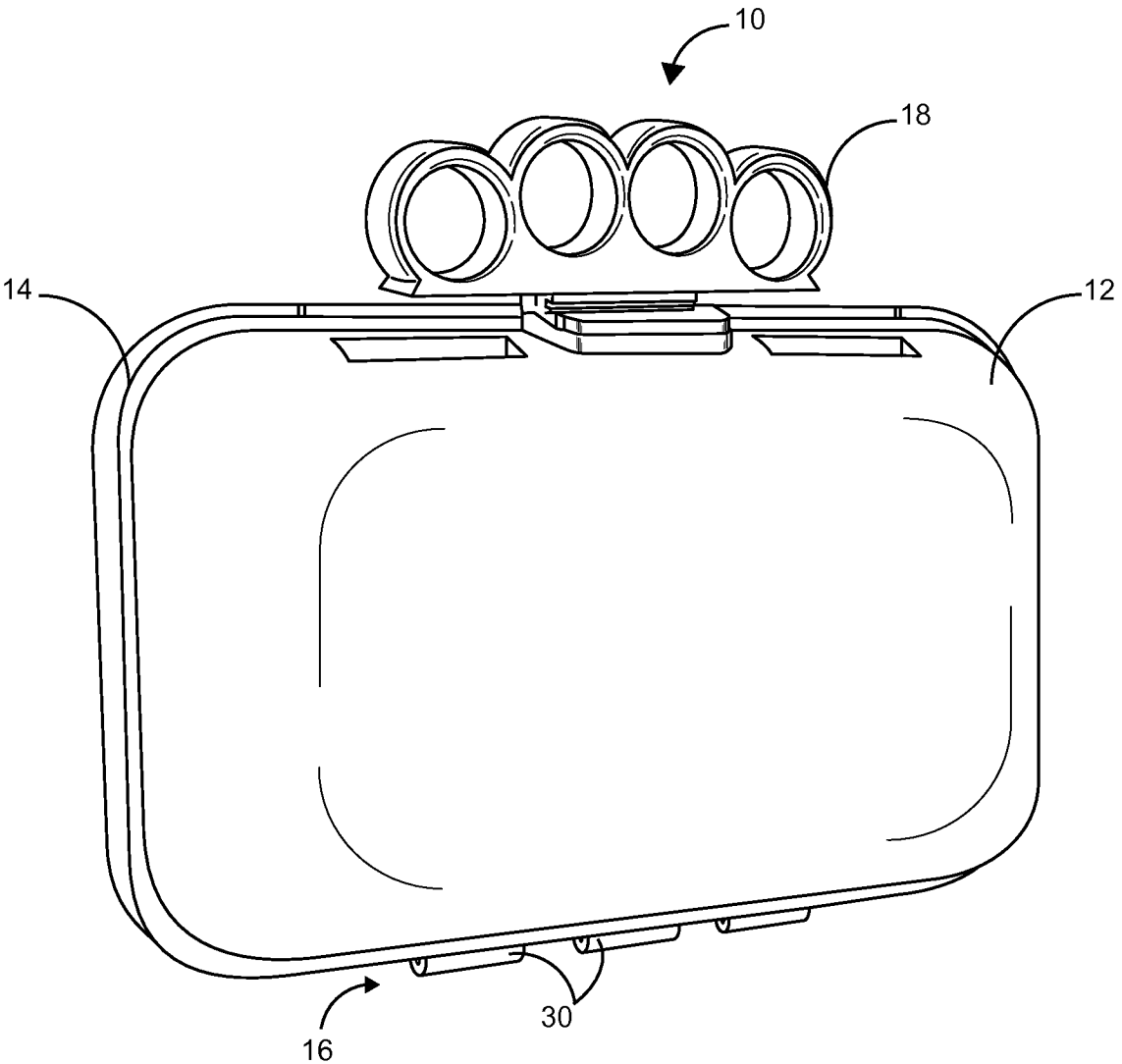
FIG. 2 is a perspective view of the customizable clutch of the present invention, illustrating the main case and an integrated hinge and outer shell locking system.
Figure 6:
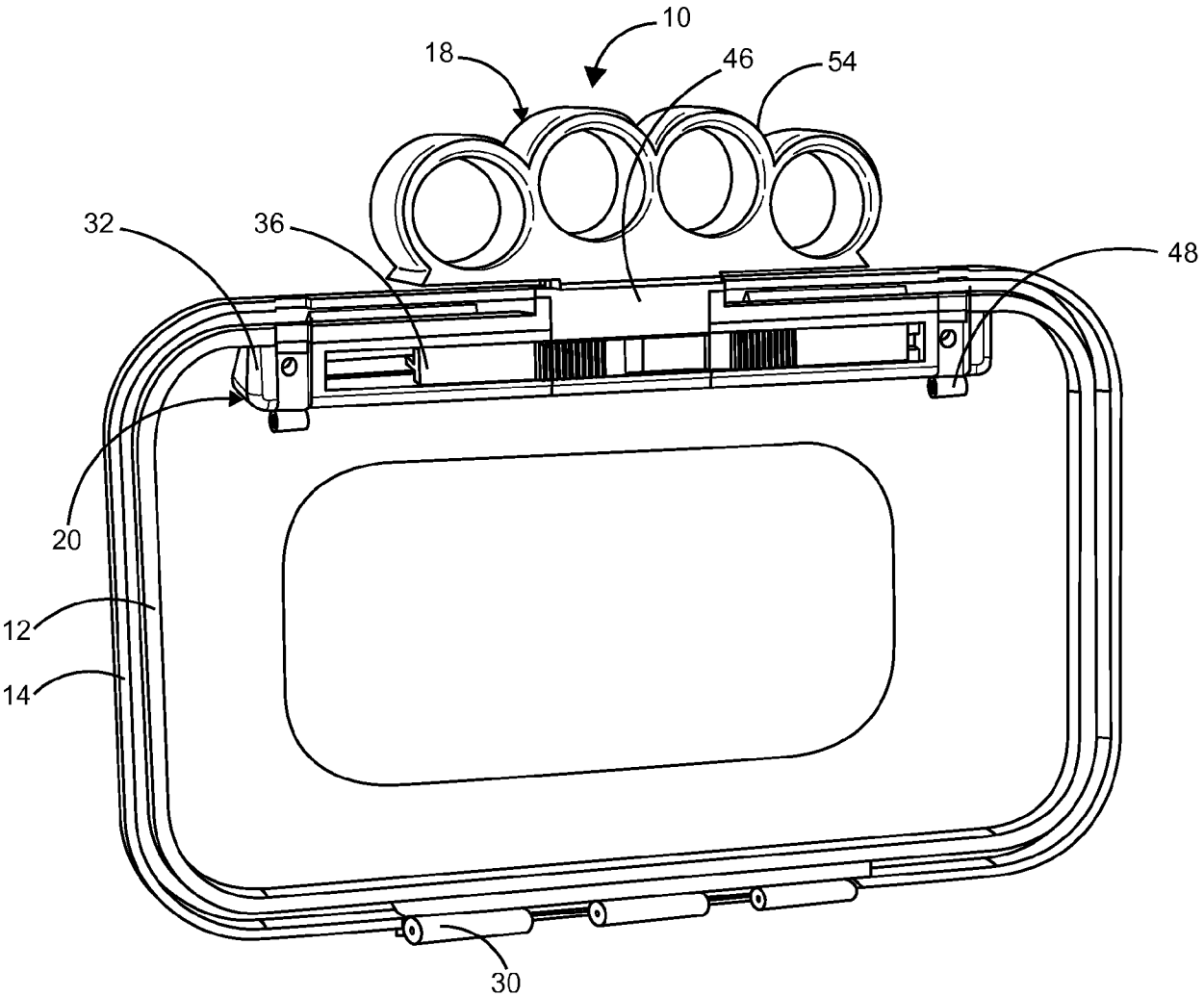
FIG. 6 is a perspective view of the customizable clutch of the present invention, illustrating a drop-in clasp system.

Referring to FIGS. 1 and 2, perspective views of a customizable clutch 10 in accordance with a preferred embodiment of the present invention are illustrated. The customizable clutch 10 comprises a rigid main case 12, an interchangeable outer shell 14 held by an integrated hinge and outer shell locking system 16, an interchangeable clasp 18 held by a drop-in clasp system 20 (FIG. 6). The main case 12 serves as a platform for the interchangeable outer shell 14 and the interchangeable clasp 18. The interchangeable outer shell 14 may have fabric or leather on its surface as well as several embellishments. In addition, the interchangeable outer shell 14 may also serve as a platform for soft fabric covers which may contain embellishments. The interchangeable clasp 18 may be of any shape and material and may contain embellishments on its surface. The interchangeable outer shell 14 and the interchangeable clasp 18 may be easily changed for coordination with different apparels that a user may wear.

Figure 3:
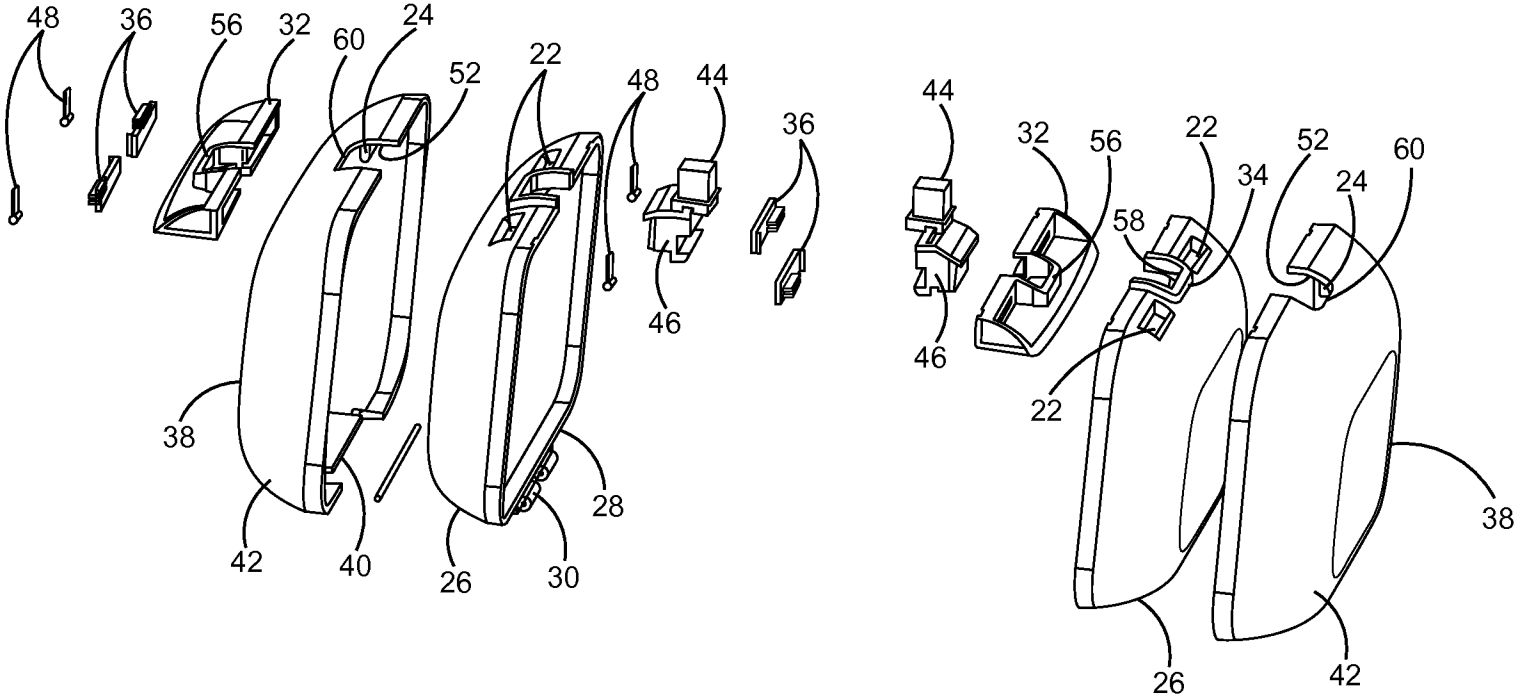
FIG. 3 is an exploded view of the customizable clutch of the present invention.

FIG. 3 is an exploded view of the customizable clutch 10 of the present invention. The rigid main case 12 of the customizable clutch 10 includes a pair of half sections 26. Each of the pair of half sections 26 is attached along a bottom side 28 by means of a hinge 30. A pair of upper insert receivers 22 is positioned along a top side 34 of the pair of half sections 26 of the main case 12. A pair of inner slider housings 32 is attached along the top side 34 of the pair of half sections 26 of the main case 12. Each of the pair of inner slider housings 32 has a pair of sliding bars 36. The interchangeable outer shell 14 of the customizable clutch 10 includes a pair of half sections 38. Each of the pair of half sections 38 of the interchangeable outer shell 14 has a lower clip 40 along a bottom side 42 and a pair of upper inserts 24 along a top inner surface 52 for removably attaching with the main case 12. The interchangeable clasp 18 of the customizable clutch 10 includes a pair of half sections 44. Each of the pair of half sections 44 has an insert 46 for removably attaching with the main case 12. The customizable clutch 10 further comprises a pair of strap attachments 48 attached on both sides of each of the pair of inner slider housings 32 for securing interchangeable chains (not shown) to the main case 12.

The interchangeable outer shell 14 encloses the main case 12. As shown in FIG. 2, the interchangeable outer shell 14 is secured to the main case 12 through the integrated hinge and outer shell locking system 16. The integrated hinge and outer shell locking system 16 includes the hinge 30 and a pair of hinge receivers 50 formed on the bottom side of the pair of half sections on both sides of the hinge 30. The pair of upper insert receivers 22 receives the pair of upper inserts 24 and then the pair of hinge receivers 50 receives the lower clip 40 of each of the pair of half sections 38 of the interchangeable outer shell 14.

Figure 4:
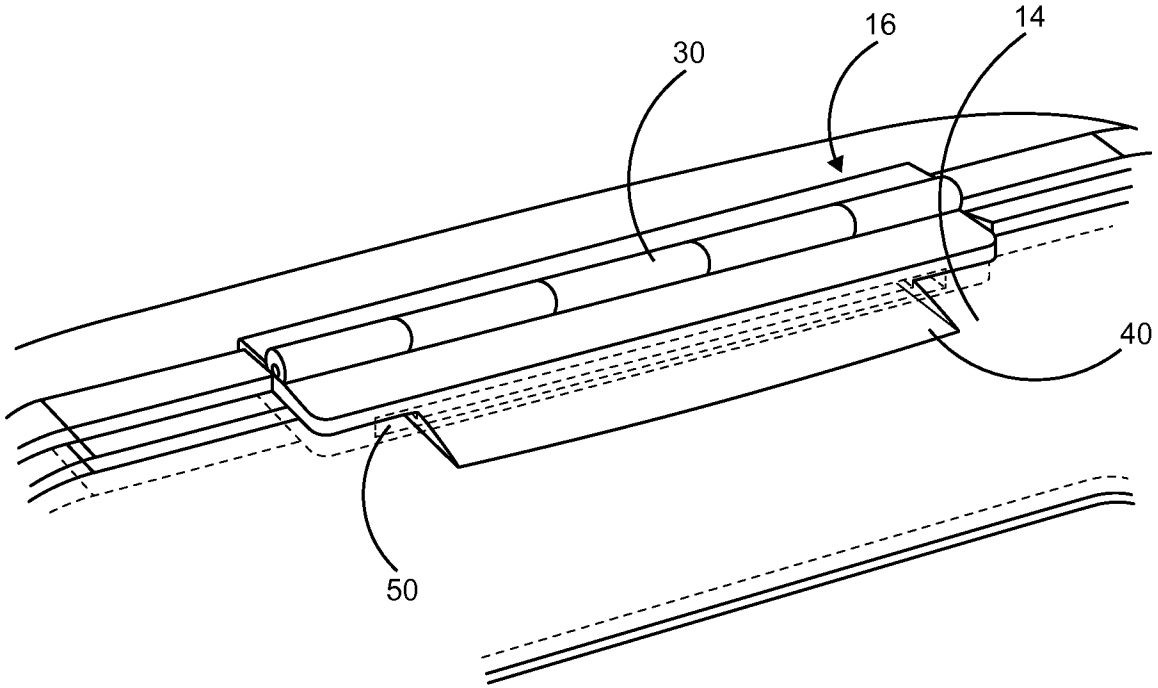
FIG. 4 is a bottom perspective view of the customizable clutch of the present invention, illustrating the integrated hinge and outer shell locking system.
Figure 5:
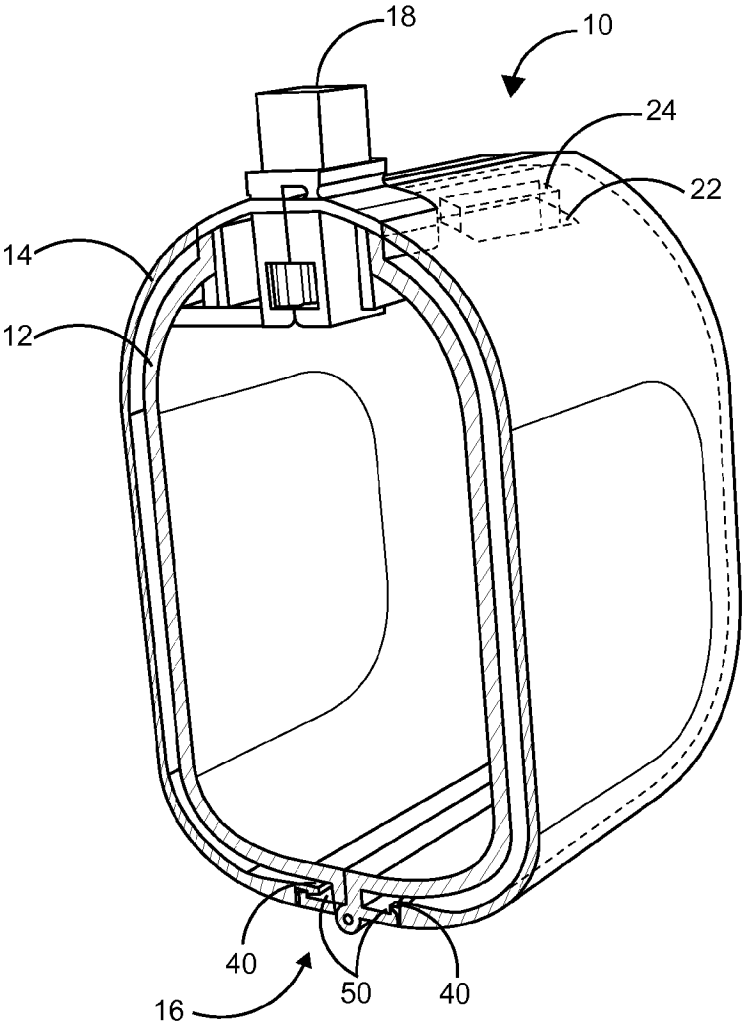
FIG. 5 is a partial cross-sectional view of the customizable clutch of the present invention, illustrating the interchangeable outer shell attaching to the main case using the integrated hinge and outer shell locking system.

FIGS. 4 and 5 illustrate different views of the customizable clutch 10 of the present invention, showing the interchangeable outer shell 14 attaching to the main case 12. To secure the interchangeable outer shell 14 to the main case 12, a user inserts the pair of upper inserts 24 on the top inner surface 52 of each of the half sections 38 of the interchangeable outer shell 14 into the pair of upper insert receivers 22 on the top side of each of the pair of half sections 26 of the rigid main case 12 and then the lower clip 40 of each of the pair of half sections 38 of the interchangeable outer shell 14 is inserted into the pair of hinge receivers 50 on both sides of the hinge 30. The pair of upper inserts 24 and the lower clip 40 allows the interchangeable outer shell 14 to be easily attached and removed from the rigid main case 12. This provides the user with desirable clutch designs and colours without having to purchase several clutches.

FIG. 6 is a perspective view of the customizable clutch 10 of the present invention, illustrating a drop-in clasp system 20. Each of the pair of half sections 44 (FIG. 3) of the interchangeable clasp 18 includes the insert 46 and a decorative part 54. The decorative part 54 may be of any shape and material and may contain embellishments on its surface. Each of the pair of half sections 44 of the interchangeable clasp 18 fasten together to close the customizable clutch 10. The interchangeable clasp 18 is secured to the main case 12 through the drop-in clasp system 20 but not limited to this specific mechanism. The drop-in clasp system 20 includes the pair of inner slider housings 32 each having the pair of sliding bars 36. The pair of sliding bars 36 may be slid into a locked position and an unlocked position to attach and remove the interchangeable clasp 18 to the main case 12 respectively.

As shown in FIG. 3, each of the pair of inner slider housings 32 comprises a cavity 56 for receiving the insert 46 of each of the pair of half sections 44 of the interchangeable clasp 18. Corresponding to the cavity 56 in each of the pair of inner slider housings 32, there is a cavity 58 in each of the pair of half sections 26 of the main case 12 and a cavity 60 in each of the pair of half sections 38 of the interchangeable outer shell 14.

Figure 7:
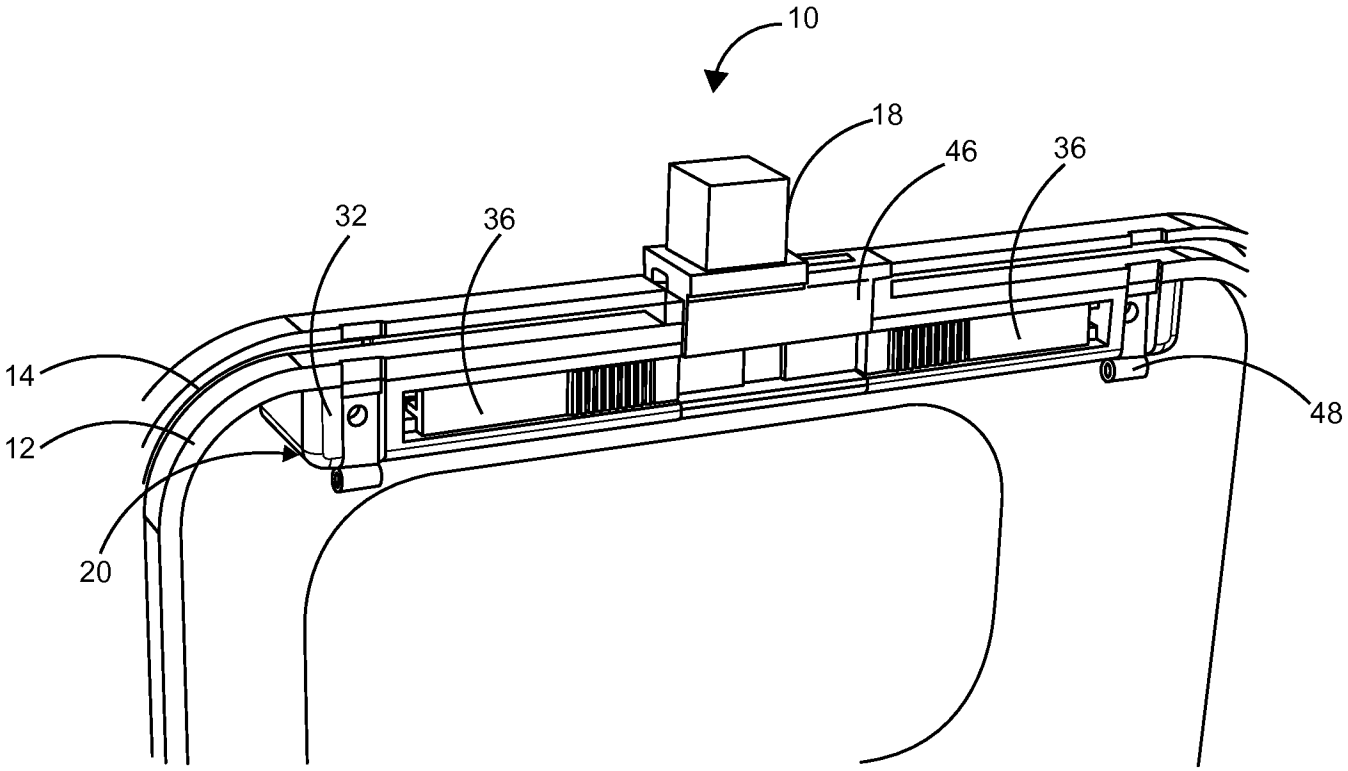
FIG. 7 is a perspective view of the customizable clutch of the present invention, illustrating the drop-in clasp system in an unlocked position.
Figure 8:
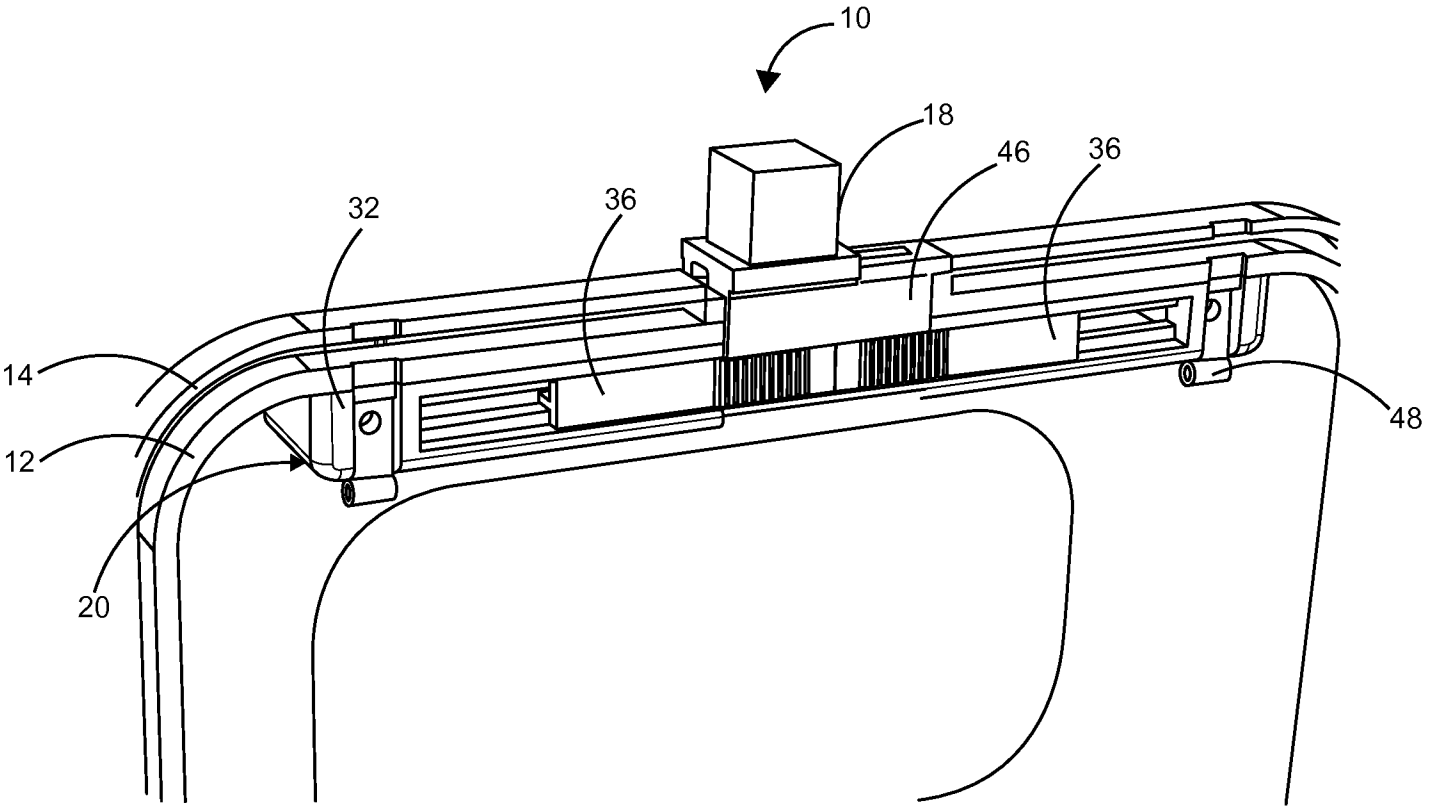
FIG. 8 is a perspective view of the customizable clutch of the present invention, illustrating the drop-in clasp system in a locked position.

Referring to FIGS. 7 and 8, perspective views of the customizable clutch 10 of the present invention, showing the drop-in clasp system 20 in an unlocked position and in a locked position respectively are illustrated. To attach the interchangeable clasp 18 to the main case 12, a user drops the insert 46 of each of the pair of half sections 44 of the interchangeable clasp 18 into the corresponding cavity 56 in each of the pair of inner slider housings 32 and the pair of sliding bars 36 is pushed into the locked position as shown in FIG. 8.

By the use of the customizable clutch 10 of the present invention, the exterior design and color of the clutch may be quickly and easily changed to correspond to whatever color or fashion desired by the user. Furthermore, transfer of the articles contained therein to a second purse's interior need not be performed. The customizable clutch 10 provides the integrated hinge and outer shell locking system 16 that facilitates the attachment of the interchangeable outer shell 14 and ensures the interchangeable outer shell 14 stays securely attached to the main case 12. The customizable clutch 10 allows users to purchase several outer shells and clasps which can then be interchanged depending on the outfit and avoid the need to purchase several clutches.

Figure 9:
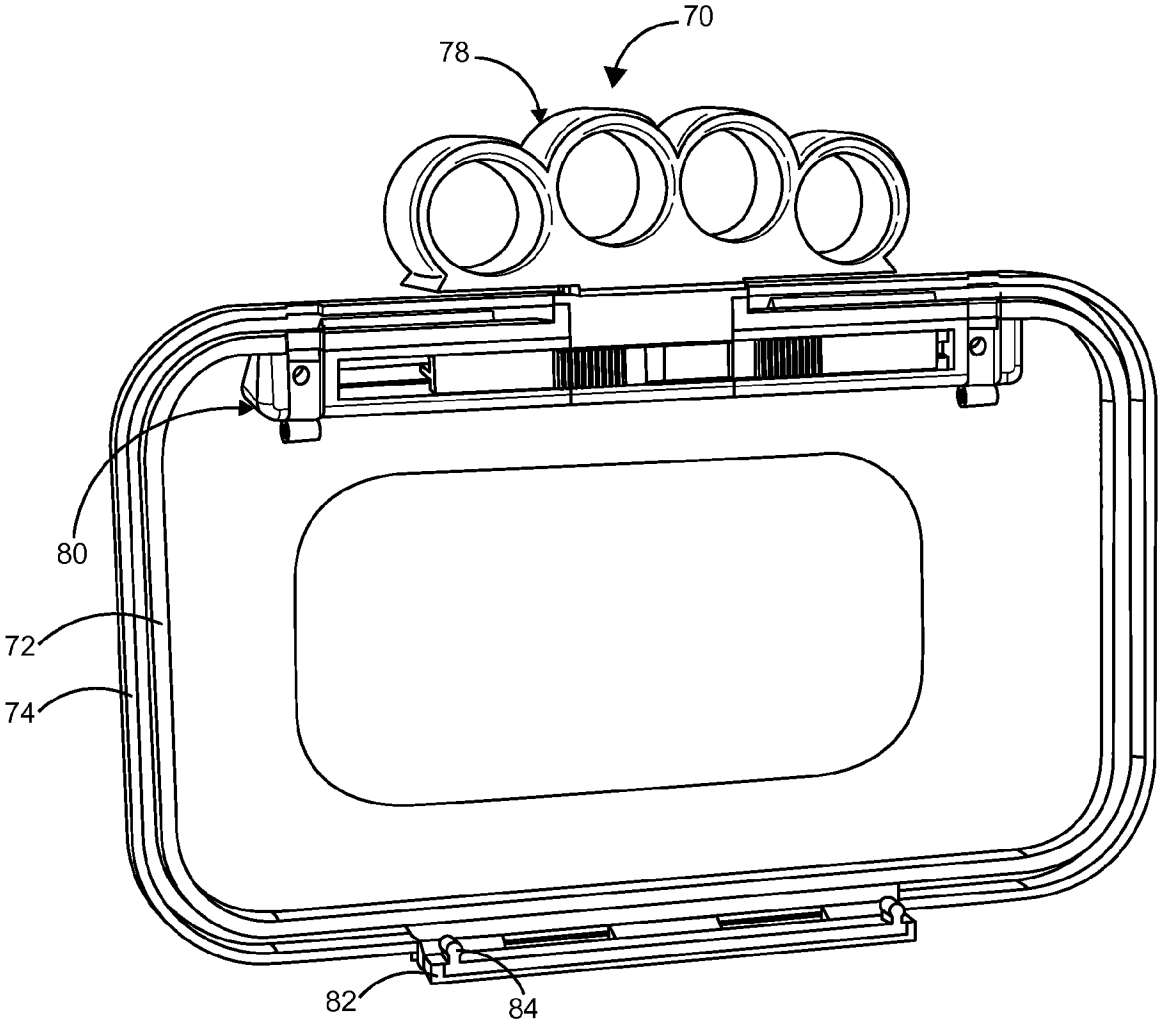
FIG. 9 is a perspective view of one embodiment of the customizable clutch of the present invention, illustrating a drop-in clasp system and a pair of hinge caps utilized to lock an interchangeable outer shell to a main case along with an integrated hinge and outer shell locking system.
Figure 10:
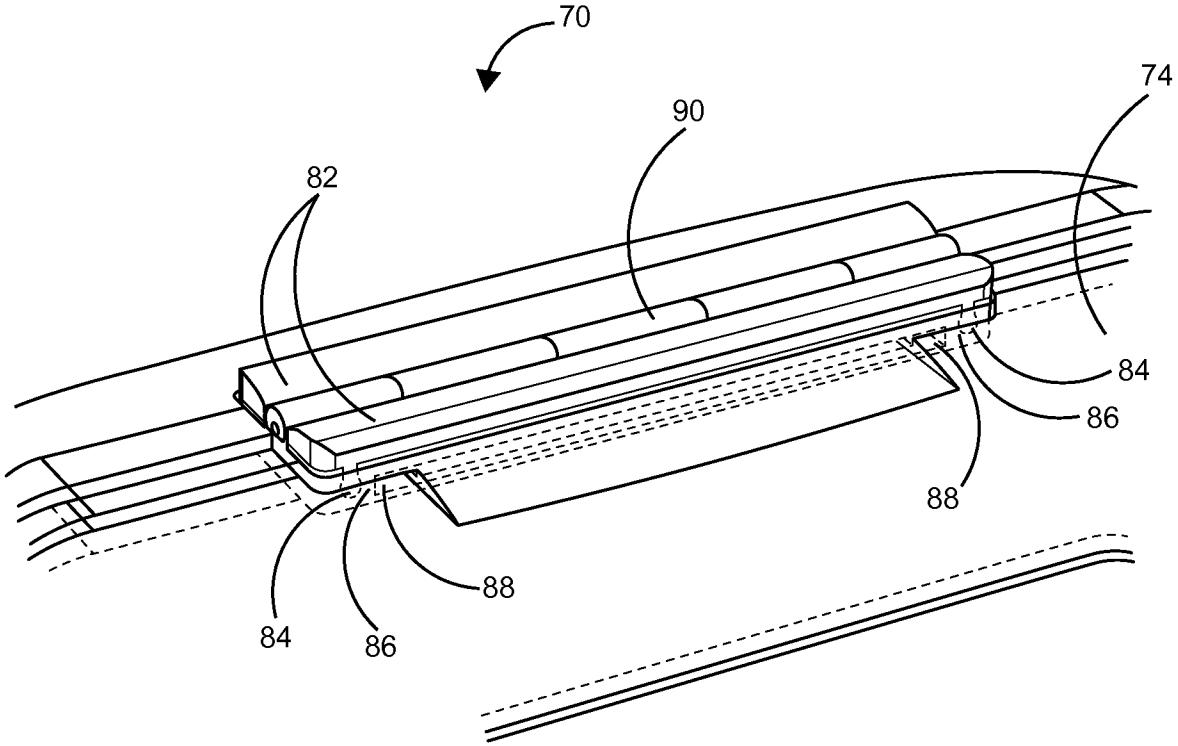
FIG. 10 is a bottom perspective view of a customizable clutch illustrated in FIG. 9, illustrating the pair of hinge caps utilized to lock an interchangeable outer shell to a main case along with an integrated hinge and outer shell locking system.

FIGS. 9 and 10 illustrate different views of one embodiment of the customizable clutch 10 of the present invention. A customizable clutch 70 in this embodiment is similar structurally and functionally to the embodiment described in FIG. 3, except includes a pair of hinge caps 82. The customizable clutch 70 comprises a rigid main case 72, an interchangeable outer shell 74 and an interchangeable clasp 78 of a drop-in clasp system 80. The rigid main case 72 includes a pair of hinge cap receivers 86 attached proximate each of a pair of hinge receivers 88 as shown in FIG. 10. Each of the pair of hinge caps 82 has a pair of protrusions 84 for removably attaching with the rigid main case 72. To secure the pair of hinge caps 82 to the main case 72, a user slides the pair of hinge caps 82 into place, such that the pair of protrusions 84 on each of the pair of hinge caps 82 slides into the pair of hinge cap receivers 86 on one side of a hinge 90. The interchangeable outer shell 74 is attached to the main case 72 using the pair of hinge caps 82 thereby preventing the interchangeable outer shell 74 from backing out and dislodging from the main case 72. Thus, the pair of hinge caps 82 provides an additional attachment point to lock the interchangeable outer shell 74 with the rigid main case 72 as shown in this embodiment. The pair of hinge caps 82 may be molded or painted to match the color of the interchangeable outer shell 74.

While a particular form of the invention has been illustrated and described, it will be apparent that various modifications can be made without departing from the spirit and scope of the invention. For example, the customizable clutch 10 may include various locking mechanism to lock shells with a main case. Accordingly, it is not intended that the invention be limited, except as by the appended claims.

What is claimed is:

1. A customizable clutch comprising:

a rigid main case having a pair of half sections, each of the pair of half sections attached along a bottom side by means of a hinge, a pair of hinge receivers on the bottom side of the pair of half sections on both sides of the hinge, a pair of upper insert receivers along a top side of the pair of half sections and a pair of inner slider housings attached along the top side of the pair of half sections, each of the pair of inner slider housings having a pair of sliding bars;

an interchangeable outer shell having a pair of half sections, each of the pair of half sections having a lower clip along a bottom side and a pair of upper inserts along a top inner surface for removably attaching with the main case; and an interchangeable clasp having a pair of half sections, each of the pair of half sections having an insert for removably attaching with the main case;

whereby the interchangeable outer shell and the interchangeable clasp may be changed for coordination with different apparels that a user may wear.

2. The customizable clutch of claim 1 wherein the pair of upper insert receivers receives the pair of upper inserts for engaging the interchangeable outer shell to the rigid main case.

3. The customizable clutch of claim 1 wherein the pair of hinge receivers receives the lower clip of each of the pair of half sections of the interchangeable outer shell for attaching the interchangeable outer shell to the main case.

4. The customizable clutch of claim 1 further comprises a pair of strap attachments attached on both sides of each of the pair of inner slider housings.

5. The customizable clutch of claim 1 wherein each of the pair of inner slider housings comprises a cavity for receiving the insert of each of the pair of half sections of the interchangeable clasp.

6. The customizable clutch of claim 1 wherein the pair of sliding bars may be slid into a locked position and an unlocked position to attach and remove the interchangeable clasp to the main case respectively.

7. The customizable clutch of claim 5 wherein the insert of each of the pair of half sections of the interchangeable clasp is dropped into the corresponding cavity in each of the pair of inner slider housings and the pair of sliding bars pushed into the locked position for attaching the interchangeable clasp to the main case.

8. The customizable clutch of claim 1 further comprises a pair of hinge caps, each having a pair of protrusions for removably attaching with the rigid main case.

9. The customizable clutch of claim 1 wherein the rigid main case further comprises a pair of hinge cap receivers attached proximate each of the pair of hinge receivers.

10. The customizable clutch of claim 9 wherein the pair of hinge cap receivers receives the pair of protrusions of each of the pair of hinge caps for attaching the pair of hinge caps to the main case.

11. The customizable clutch of claim 8 wherein the pair of hinge caps provides an additional attachment point to lock the interchangeable outer shell with the rigid main case without dislodging.

12. A customizable clutch comprising:

a rigid main case having a pair of half sections, each of the pair of half sections attached along a bottom side by means of a hinge, a pair of hinge receivers on the bottom side of the pair of half sections on both sides of the hinge, a pair of upper insert receivers along a top side of the pair of half sections, a pair of inner slider housings attached along the top side of the pair of half sections of the main case, a pair of sliding bars positioned in each of the pair of inner slider housings, and a pair of strap attachments attached on both sides of each of the pair of inner slider housings;

an interchangeable outer shell having a pair of half sections, each of the pair of half sections having a lower clip along a bottom side and a pair of upper inserts along a top inner surface for removably attaching with the main case; and an interchangeable clasp having a pair of half sections, each of the pair of half sections having an insert for removably attaching with the main case;

whereby the interchangeable outer shell and the interchangeable clasp may be changed for coordination with different apparels that a user may wear.

13. The customizable clutch of claim 12 wherein the pair of upper insert receivers receives the pair of upper inserts of each of the pair of half sections of the interchangeable outer shell for engaging the interchangeable outer shell to the rigid main case.

14. The customizable clutch of claim 12 wherein the pair of hinge receivers receives the lower clip of each of the pair of half sections of the interchangeable outer shell for attaching the interchangeable outer shell to the main case.

15. The customizable clutch of claim 12 wherein each of the pair of inner slider housings comprises a cavity for receiving the insert of each of the pair of half sections of the interchangeable clasp.

16. The customizable clutch of claim 15 wherein the insert of each of the pair of half sections of the interchangeable clasp is dropped into the corresponding cavity in each of the pair of inner slider housings and the pair of sliding bars pushed into a locked position to attach the interchangeable clasp to the main case.

17. A customizable clutch comprising:

a rigid main case having a pair of half sections, each of the pair of half sections attached along a bottom side by means of a hinge, a pair of hinge receivers on the bottom side of the pair of half sections on both sides of the hinge, a pair of upper insert receivers along a top side of the pair of half sections, a pair of inner slider housings attached along a top side of the pair of half sections of the main case, a pair of sliding bars positioned in each of the pair of inner slider housings, and a pair of strap attachments attached on both sides of each of the pair of inner slider housing;

an interchangeable outer shell having a pair of half sections, each of the pair of half sections having a pair of upper inserts along a top inner surface for inserting into the pair of upper insert receivers and a lower clip along a bottom side for inserting into the pair of hinge receivers to removably attach the interchangeable outer shell with the main case; and an interchangeable clasp having a pair of half sections, each of the pair of half sections having an insert for inserting into a cavity of each of the pair of inner slider housings to removably attach the interchangeable clasp with the main case;

whereby the interchangeable outer shell and the interchangeable clasp may be changed for coordination with different apparels that a user may wear.

18. The customizable clutch of claim 17 wherein the insert of each of the pair of half sections of the interchangeable clasp is dropped into the corresponding cavity in each of the pair of inner slider housings and the pair of sliding bars pushed into a locked position for attaching the interchangeable clasp to the main case.

* * * * *